US009976306B1

(12) United States Patent
Horner

(10) Patent No.: US 9,976,306 B1
(45) Date of Patent: May 22, 2018

(54) WALL SUPPORT STRUCTURES AND SYSTEMS

(71) Applicant: AARON CARLSON CORPORATION, Minneapolis, MN (US)

(72) Inventor: Jason Horner, Forest Lake, MN (US)

(73) Assignee: AARON CARLSON CORPORATION, Minneapolis, MN (US)

( * ) Notice: Subject to any disclaimer, the term of this patent is extended or adjusted under 35 U.S.C. 154(b) by 0 days. days.

(21) Appl. No.: 15/475,515

(22) Filed: Mar. 31, 2017

(51) Int. Cl.

| | |
|---|---|
| ***E06B 1/04*** | (2006.01) |
| ***E04C 3/36*** | (2006.01) |
| ***F41H 5/24*** | (2006.01) |
| ***E04B 2/70*** | (2006.01) |
| ***E04B 1/92*** | (2006.01) |
| ***E04H 9/06*** | (2006.01) |

(52) U.S. Cl.
CPC ..... *E04C 3/36* (2013.01); *E04B 1/92* (2013.01); *E04B 2/70* (2013.01); *E04H 9/06* (2013.01); *F41H 5/24* (2013.01)

(58) Field of Classification Search
CPC ..... E04C 3/36; E04B 1/92; E04H 9/06; E06B 5/106; E06B 5/10; F41H 5/24; F41H 5/0407
See application file for complete search history.

(56) References Cited

U.S. PATENT DOCUMENTS 3,924,038 A * 12/1975 McArdle ..... F41H 5/0414 109/49.5
4,470,357 A 9/1984 Sanzaro
(Continued)

FOREIGN PATENT DOCUMENTS

CN 200992924 Y 12/2007
CN 104563799 A 4/2015
(Continued)

OTHER PUBLICATIONS

"Aaron Carlson Ballistics Architectural Woodwork," ACC Ballistics Brochure, pp. 1-8, Nov. 2016.
(Continued)

*Primary Examiner* — Brian D Mattei
(74) *Attorney, Agent, or Firm* — Seager, Tufte & Wickhem LLP

(57) ABSTRACT

Building components and building systems are disclosed. An example building component may include a ballistic resistant wall support. The ballistic resistant wall support may include a support structure and a ballistic resistant component connected to the support structure and covering or extending along a portion of the support structure. In some cases, the ballistic resistant component may define one or more pockets for receiving a wall panel. The ballistic resistant wall support may include two such pockets and may be used in a wall system incorporating other ballistic resistant components, such as wall panels, doors, door frames, and/or other components. In such wall systems, the ballistic resistant wall support may include ballistic resistant material that spans a gap between ballistic resistant material of adjacent wall panels received in the pockets of the wall support to provide a continuous ballistic resistant barrier.

17 Claims, 11 Drawing Sheets

(56) References Cited

U.S. PATENT DOCUMENTS

| | | | | |
|---|---|---|---|---|
| 4,567,100 | A | 1/1986 | Pickett et al. | |
| 5,469,796 | A | 11/1995 | Koenig | |
| 6,327,954 | B1 * | 12/2001 | Medlin | F41H 5/0407 296/96.21 |
| 6,708,595 | B1 * | 3/2004 | Chaussade | B32B 17/10064 428/911 |
| 7,908,958 | B2 * | 3/2011 | Mandelartz | B32B 17/10045 428/119 |
| 8,011,146 | B2 | 9/2011 | Krause | |
| 8,245,619 | B2 | 8/2012 | Hall | |
| 8,991,118 | B2 | 3/2015 | Tunis, III et al. | |
| 9,200,480 | B2 | 12/2015 | Deiler | |
| 9,212,482 | B2 | 12/2015 | Frederick | |
| 2004/0163571 | A1 | 8/2004 | Fortin | |
| 2008/0092731 | A1 | 4/2008 | Hall | |
| 2010/0297388 | A1 | 11/2010 | Dagher et al. | |
| 2011/0239851 | A1 | 10/2011 | Mason et al. | |
| 2012/0167371 | A1 | 7/2012 | Mateu Climent | |
| 2014/0000194 | A1 | 1/2014 | Daniels et al. | |
| 2014/0360416 | A1 | 12/2014 | Deiler | |
| 2015/0096479 | A1 | 4/2015 | McCarthy et al. | |
| 2015/0143986 | A1 | 5/2015 | Tunis, III et al. | |
| 2015/0292841 | A1 | 10/2015 | Fultz et al. | |
| 2016/0281416 | A1 | 9/2016 | Spransy | |

FOREIGN PATENT DOCUMENTS

| | | | |
|---|---|---|---|
| CN | 105332617 | A | 2/2016 |
| EP | 2133650 | A2 | 12/2009 |
| GB | 2050941 | A | 1/1981 |
| GB | 2258488 | A | 2/1993 |

OTHER PUBLICATIONS

"Lloyd Doors Combined Set," Engineering drawings for an installed door, Aaron Carlson Corp, pp. 1-6, 2014.

"Revised Lloyd Doors Sheet 4,", Engineering drawings for an installed door, Aaron Carlson Corp, pp. 1-1, 2014.

* cited by examiner

WALL SUPPORT STRUCTURES AND SYSTEMS

TECHNICAL FIELD

The present disclosure pertains to wall structures, and methods for manufacturing and using wall structures. More particularly, the present disclosure pertains to ballistic wall structures including bullet resistant ballistic wall supports, wall panels, door frames, and doors.

BACKGROUND

A wide variety of wall structures have been developed for various uses in various types of building structures. Some of these wall structures may include bullet resistant ballistic doors and wall panels used to restrict penetration of bullets and/or shrapnel through the wall structure. These structures are manufactured by any one of a variety of different manufacturing methods and may be used according to any one of a variety of methods. Of the known wall structures and methods, each has certain advantages and disadvantages.

BRIEF SUMMARY

This disclosure provides, design, material, manufacturing method, and use alternatives for wall structures. In a first aspect, a ballistic resistant wall support may have an interior side and an exterior side and may include a support structure and a ballistic resistant component rigidly connected to the support structure. The support structure may have a first side and a second side opposite the first side, where the ballistic resistant component may extend along the first side of the support structure. In some cases, the ballistic resistant component may define a pocket for receiving a wall panel.

Additionally or alternatively, in another aspect, a ballistic resistant mullion or transom may include a pocket, a main body at least partially defining the pocket, and a stop component at least partially defining the pocket. In some cases, the stop component may be separate from the main body and may be configured to be connected to the main body after the main body is installed and/or a wall panel has been received in the pocket of the main body to facilitate easy installation of the wall panel. Further, the main body and the stop component may be formed from a ballistic resistant material and a structural framing material.

Additionally or alternatively, in another aspect, a ballistic resistant wall system may form a continuous ballistic resistant barrier. The wall system may include a ballistic resistant wall support and a ballistic resistant wall panel. The ballistic resistant wall support may include a support structure component and a ballistic resistant component. The support structure may have a first side and a second side opposite the first side and the ballistic resistant component may be located adjacent to the first side of the support structure component. Further, the ballistic resistant component may define a pocket and may receive the ballistic resistant wall panel within the pocket.

The above summary of some embodiments is not intended to describe each disclosed embodiment or every implementation of the present invention. The Figures, and Detailed Description, which follow, more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
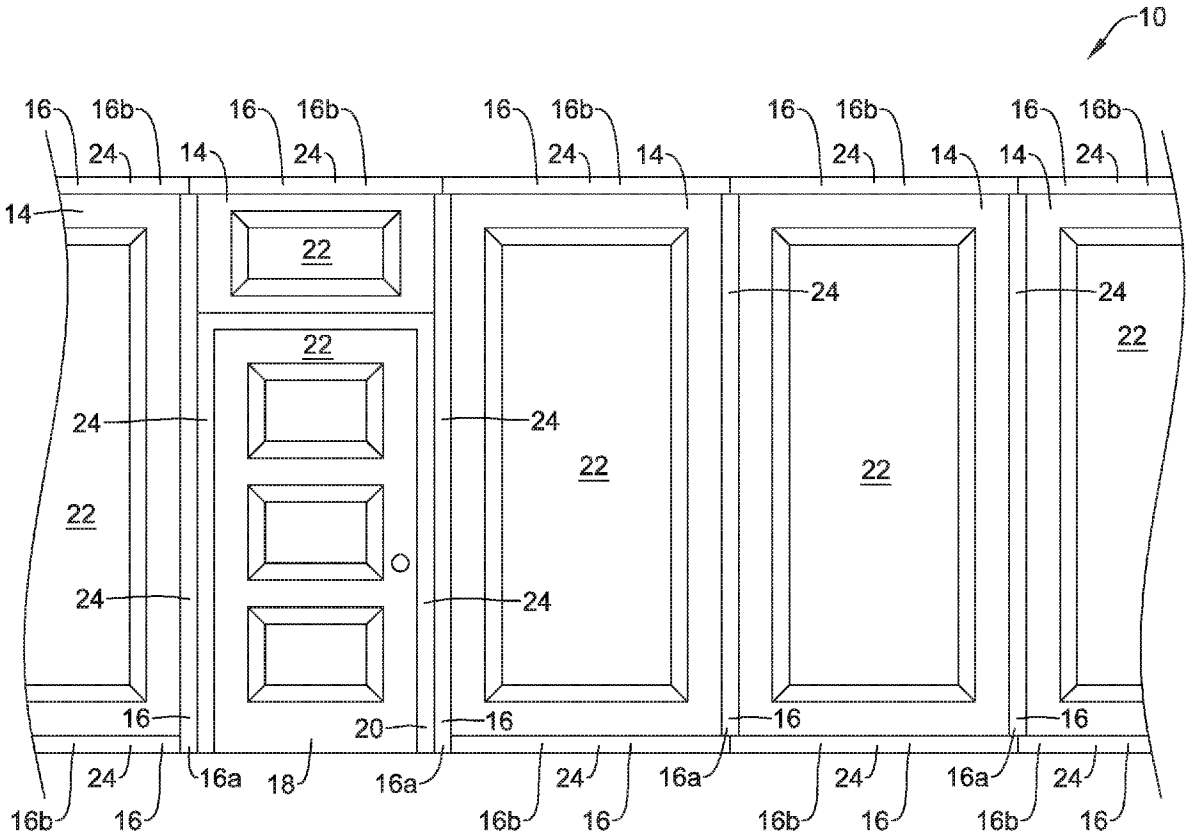
FIG. 1 is an elevation view illustrating an example wall system with wall panels having a wood exterior.

While the disclosure is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure.

DETAILED DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (e.g., having the same function or result). In many instances, the term "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include one or more particular features, structures, and/or characteristics. However, such recitations do not necessarily mean that all embodiments include the particular features, structures, and/or characteristics. Additionally, when particular features, structures, and/or characteristics are described in connection with one embodiment, it should be understood that such features, structures, and/or characteristics may also be used in connection with other embodiments whether or not explicitly described unless clearly stated to the contrary.

The following detailed description should be read with reference to the drawings in which similar elements in different drawings are numbered the same. The drawings, which are not necessarily to scale, depict illustrative embodiments and are not intended to limit the scope of the invention.

Walls and wall structures may have various designs, may have various dimensions, and may be made from various materials. In some cases, the designs, dimensions, and materials of a wall or wall structure may depend, at least in part, on the purpose of the wall.

Typical walls and wall structures may be provided for various decorative and/or functional purposes. For example, walls and wall structures may be provided for decorative purposes and may include painted artwork, sculpted artwork, wood designs, and/or other decorative features. Further, walls and wall structures may be provided to allow people to see through (e.g., a wall or wall structure including one or more windows), to keep people, animals, weather, and/or objects in or out of a building, to protect occupants of a building, and/or to provide one or more other functional purpose. In one example, a wall or wall structure may be provided with a decorative or functional purpose to protect people and things on one side of the wall or wall structure from bullets and/or other ballistic material on another side of the wall or wall structure. That is, walls or wall structures may be configured to be ballistic resistant.

Further, walls or wall structures may be generally configured in a grid-like pattern or other pattern, where a wall panel may be supported by panel supports. Examples of such walls or wall structures may be storefront wall systems, curtainwall wall systems, and/or other wall systems. Curtainwall wall systems and/or other wall systems may typically comprise a grid-like framework usually made of aluminum or steel transoms (e.g., structures that typically run horizontally) and mullions (e.g., structures that typically run vertically), where the framework typically may be attached to a building structure and may typically receive glazing or window panels and/or non-transparent panels.

In some cases, a wall or wall structure may have a wall panel and at least one wall support extending along an edge of the wall panel. In the case of a storefront wall system, curtainwall wall systems, or other wall structure, wall panels may be assembled in cells with one or more supports surrounding each wall panel. In one example when a wall panel has a rectangular shape, a wall panel may have a first wall support along a first edge of the wall panel, a second wall support along a second edge of the wall panel, a third wall support along a third edge of the wall panel, and a fourth wall support along a fourth edge of the wall panel. In a further example, the cells of a wall or wall structure may be assembled such that each cell includes a wall panel with two vertical wall supports (e.g., mullions) and two horizontal wall supports (e.g., transoms), where the wall or wall structure may include one or more rows and/or columns of walls supported by vertical wall supports and/or horizontal wall supports. Further, in some cases, wall panels may share horizontal wall supports and/or vertical wall supports with adjacent wall panels.

Ballistic resistant walls or wall structures may typically include a ballistic resistant wall panel (e.g., a panel of ballistic resistant glass or other panel including ballistic resistant material) surrounded by wall supports or brackets to join adjacent ballistic resistant wall panels. However, ballistic resistant wall panels are typically connected to one another with brackets or other wall supports that are not ballistic resistant (e.g., do not have a ballistic resistant rating similar to a ballistic resistant rating of the wall panels being connected) such that walls or wall systems including ballistic resistant wall panels may include weak points (e.g., points that are not rated as being ballistic resistant) along edges of the wall panels. In one example of a standard or typical curtainwall or storefront wall system or other wall system including ballistic resistant wall panels, adjacent ballistic resistant wall panels may be connected with vertical and/or horizontal wall supports (e.g., steel or aluminum wall supports) that are generally used to connect adjacent non-ballistic resistant wall panels of a wall or wall system. Such a configuration results in a wall or wall system with ballistic resistant wall panels having joints between the ballistic resistant wall panels are not ballistic resistant or are not ballistic resistant to a level similar to a level of the wall panels. In some cases, the weak or non-ballistic resistant joints may be covered by ballistic resistant material, but this adds cost and material to the assembly while increasing wall assembly steps and time for assembly as the additional ballistic resistant material needs to be connected post-assembly of the wall.

A "ballistic resistant" thing or material may be defined as a thing or material that provides protection to a person or object positioned behind the thing or material against complete penetration of a projectile (e.g., a bullet or other projectile), passage of fragments or projectiles therethrough, or fragmentation of the thing or material in response to a projectile engaging the thing or material. The standards set by the current UL 752 may be utilized to determine a level of ballistic resistance for a thing or material (e.g., wall panel, wall support, material thereof, and/or other thing or material).

Under the current UL 752 standard, a ballistic resistant thing or material having a protection level of Level 1 will protect against handguns of medium power (e.g., hand guns firing 9 mm full metal copper jacket with lead core ammunition or handguns having a muzzle energy of 380-460 foot pounds or 515-624 Joules), a ballistic resistant thing or material having a protection level of Level 2 will protect against handguns of higher power (e.g., handguns firing 0.357 magnum jacket lead soft point ammunition or handguns having a muzzle energy of 548-663 foot pounds or 743-899 Joules) Joules, a ballistic resistant thing or material having a protection level of level 3 will protect against handguns of super power (e.g., handguns firing 0.4 magnum lead semi-wadcutter gas checked ammunition or having a muzzle energy of 971-1,175 foot pounds or 1,317-1,593 Joules), a ballistic resistant thing or material having a ballistic resistance level of Level 4 will protect against low caliber rifles (e.g., .30 caliber rifle lead core soft point (.30-06 caliber), a ballistic resistant thing or material having a ballistic resistance level of Level 5 will protect against one shot of rifle ammunition (e.g., 7.62 mm rifle lead core full metal copper jacket, military ball (.308 caliber)—1 shot), and a ballistic resistant thing or material having a ballistic resistance level of Level 8 will protect against five shots of rifle ammunition (e.g., 7.62 mm rifle lead core full metal copper jacket, military ball (.308 caliber)—5 shots). These are just some example levels of ballistic resistance as set by the current UL 752 standard, but the current UL 752 standard has additional levels. Additionally, other standards (e.g., National Institute of Justice Body Armor Classification standards and/or other standards) may be utilized for determining a level of ballistic resistance for a thing or material.

Figure 2:
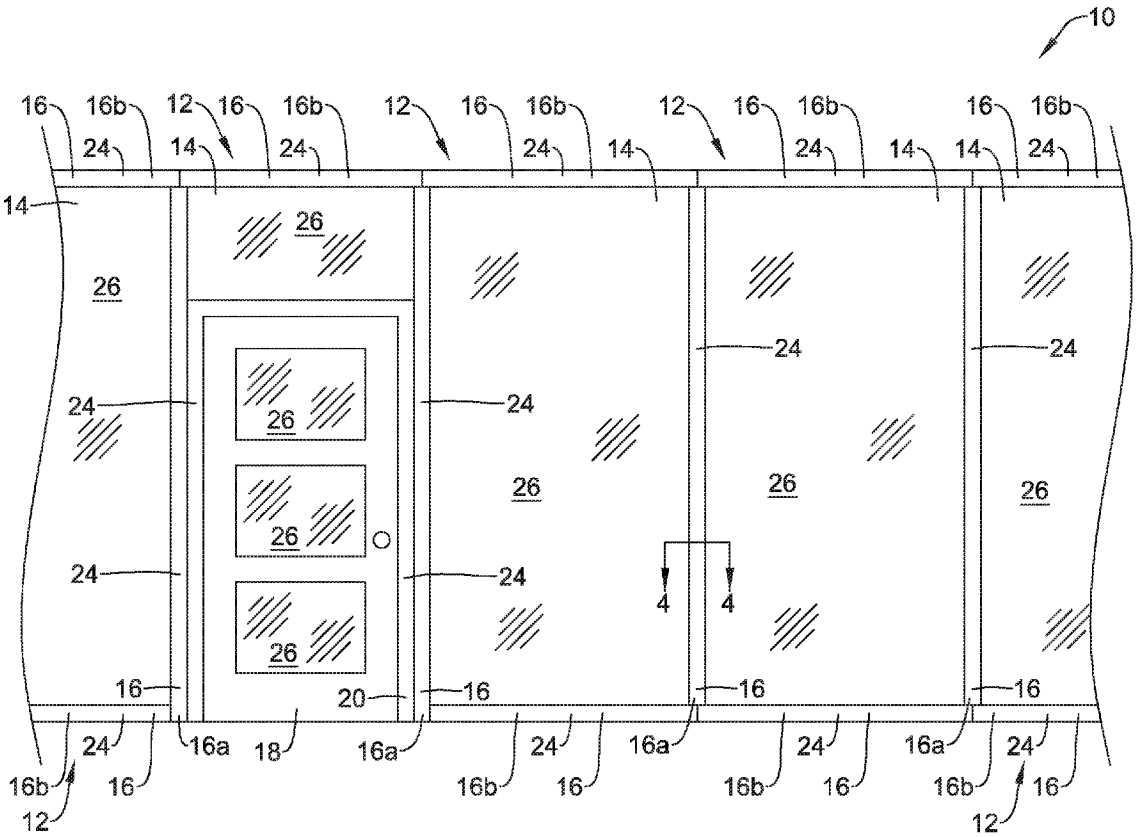
FIG. 2 is an elevation view illustrating an example wall system with glass wall panels.

Turning to the Figures, FIGS. 1 and 2 depict examples of a row of a wall or wall system 10. Although only a single row is shown in each of FIG. 1 and FIG. 2, additionally rows of the wall or wall system 10 may be added above and/or below the depicted row. Each wall or wall system 10 may include a plurality of cells 12, where a cell 12 may include a wall panel 14 and a wall supports 16 surrounding the wall panel 14. Additionally, although not required, one or more cells 12 of the wall or wall system 10 may include a door 18 surrounded by a door frame 20.

FIG. 1 depicts a row of a ballistic resistant wall or wall system 10 that includes a plurality of cells 12 having a wall panel 14 surrounded by wall supports 16 and a cell 12 having a door 18 surrounded by a frame 20. In some cases, adjacent cells 12 above and below a cell 12 may share one or more wall supports 16. The wall panels 14, wall supports 16, the door 18, and door frame 20 of FIG. 1 may be ballistic resistant and have a decorative veneer. In some cases, the decorative veneer may be made from a finished hard wood (e.g., hardwood 22 and trim or casing 24, as shown in FIG. 1), a finished polymer, a finished metal, a painted surface, and/or other decorative veneer. Further, the ballistic resistant material used to make one ballistic resistant portion of the wall or wall system 10 may be the same material or a different material than a bullet resistant material used to make at least one other or all other ballistic resistant portions of the wall or wall system 10. In some cases, the wall or wall system 10 of FIG. 1 may have a Level 3 bullet resistant rating under the current UL 752 standard or a different rating.

The wall supports 16 of cell 12, as shown in FIG. 1, may be elongated and may include two parallel vertical wall supports (e.g., mullions) 16*a* and two parallel horizontal wall supports (e.g., transoms) 16*b*. As discussed in greater detail below, the wall supports 16 may be configured such that ballistic resistant material of the wall supports 16 overlaps with edges of ballistic resistant material of adjacent wall panels 14 to provide ballistic resistant joints in the wall or wall system 10 between adjacent and/or received wall panels 14. In one example, as shown in FIG. 1, one or more wall panels 14 of the wall or wall system 10 may include a ballistic resistant material between a first hardwood layer and a second hardwood layer and edges of the ballistic resistant material with or without one or more of the first hardwood layer and the second hardwood layer may be received within the wall supports 16. In some cases, the wall supports 16 may have having trim or casing 24 attached thereto (e.g., covering ballistic resistant material of the wall supports 16) to conceal a ballistic resistant nature of the wall or wall system 10. Alternatively or in addition, the wall supports 16 may be configured around edges of the wall panels 14 in one or more other manners.

FIG. 2 depicts a row of a ballistic resistant wall or wall system 10 that includes a plurality of cells 12 having a wall panel 14 surrounded by wall supports 16 and a cell 12 having a door 18 surrounded by a frame 20. In some cases, adjacent cells 12 above and below a cell 12 may share one or more wall supports 16. The wall supports 16, the door 18, and door frame 20 of FIG. 2 may be ballistic resistant and may have a decorative veneer. In some cases, the decorative veneer may be made from a finished hard wood (e.g., trim, as shown in FIG. 2), a finished polymer, a finished metal, a painted surface, and/or other decorative veneer. The wall panels 14 in the wall or wall system 10 of FIG. 2 may include a ballistic resistant glass 26 (e.g., at least partially transparent glass having layers of glass with layers of polyvinyl butyral, layers of glass with layers of polycarbonate, layers of polycarbonate with layers of polyurethane, and/or other ballistic resistant glass). The wall or wall system 10 of FIG. 2 may have a Level 3 bullet resistant rating under the current UL 752 standard.

The wall supports 16 of a cell 12, as shown in FIG. 2, may include two parallel vertical wall supports (e.g., mullions) 16*a* and two parallel horizontal wall supports (e.g., transoms) 16*b*. As discussed in greater detail below, the wall supports 16 may be configured such that ballistic resistant material of the wall supports 16 overlaps with edges of ballistic resistant material of adjacent and/or received wall panels 14 to provide ballistic resistant joints in the wall or wall system 10. In one example, edges of the ballistic resistant glass 26 of the wall panels 14 in FIG. 2 may be received within the wall supports 16 to provide a wall or wall system 10 that is a continuous ballistic resistant barrier. In such cases, the wall supports 16 may include trim or casing 24 attached thereto (e.g., covering ballistic resistant material of the wall supports 16) to conceal a ballistic resistant nature of the wall supports 16 and/or the wall or wall system 10, and/or for decorative or other purposes. Alternatively or in addition, the wall supports 16 may be configured around edges of the wall panels 14 in one or more other manners.

Figure 3:
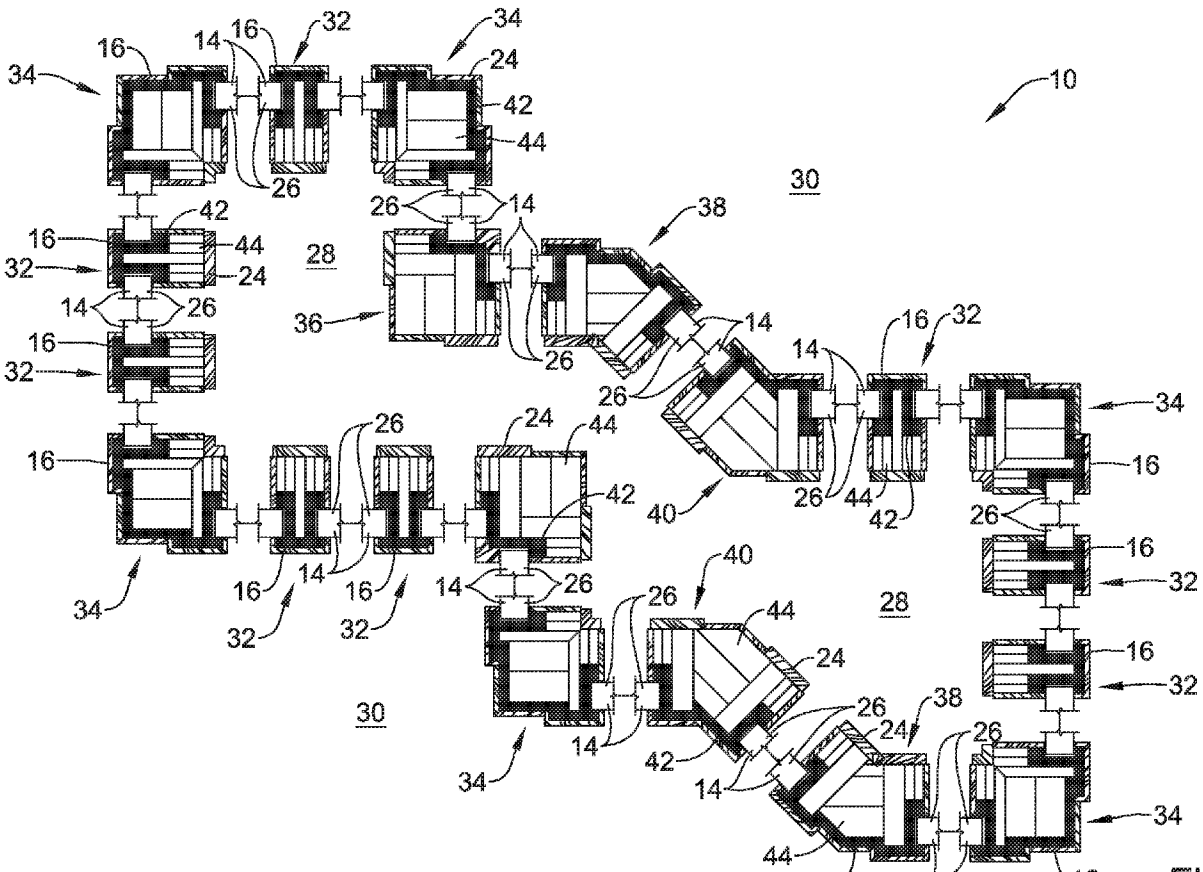
FIG. 3 is a schematic plan view illustrating an example wall system.

FIG. 3 is a schematic plan view of an illustrative wall or wall system 10 incorporating various wall supports 16 (e.g., vertical wall supports 16, such as mullions, which may be similar to horizontal wall supports, such as transoms). The wall or wall system 10 of FIG. 3 may be configured to protect people or things in an interior 28 of the wall or wall system 10 from ballistic material engaging the wall or wall system 10 from an exterior 30. Although the wall or wall system 10 in FIG. 3 has a particular shape and arrangement with various wall panels 14 (e.g., for clarity purposes, only one wall panel 14 on a wall segment is labeled in FIG. 3) and wall supports 16, the wall or wall system 10 may take on any dimensions, may have one or more vertical layers of cells 12, or may include one or more doors 18, door frames 20, horizontal wall supports 16*b*, and/or may include one or more other features.

The wall supports 16 may have any configuration configured to receive wall panels 14 and maintain a ballistic resistant nature of a wall or wall system 10 between adjacent wall panels 14 or a wall panel 14 and one or more other ballistic resistant structures. Among other configurations, a wall or wall system 10 may include wall supports 16 depicted in FIG. 3, which include one or more in-line supports 32 (see FIG. 4), one or more exterior corner supports 34 (see FIG. 6), one or more interior corner supports 36 (see FIG. 7), one or more exterior angled supports 38 (see FIG. 8), one or more interior angled supports 40 (see FIG. 9), and/or one or more other configurations of wall supports 16 (e.g., see FIG. 10).

Further, as shown in FIG. 3, each wall support 16 may include a ballistic resistant layer or component 42 and a support layer or structure 44. In some cases, one or more of the wall supports 16 of the wall or wall system 10 may include trim or casing 24 or a casing layer. Note, for clarity purposes, the ballistic resistant component 42, the support structure 44, and the trim or casing 24 are labeled once for each wall support 16 configuration depicted in FIG. 3.

As mentioned, the wall supports 16 may be elongated. Each of the wall supports 16 (e.g., both vertical wall supports 16*a*, such as mullions, and horizontal wall supports 16*b*, such transoms) may have a length that depends on an application of use of the wall support 16. In one example, a wall support 16 may have a length of eight (8) feet or less, twelve (12) feet or less, sixteen (16) feet or less, twenty (20) feet or less, twenty-four (24) feet or less, or greater than twenty-four (24) feet. In some cases, a length of each wall support 16 may be the same for an entire wall or wall system 10 or a length of a wall support 16 may be different than a length of at least one other wall support 16 of the wall or wall system 10.

Further, each of the wall supports 16 may have a width that depends on an application of use of the wall support 16. In one example, a wall support 16 may have a width less than 1¾ inches, less than 2½ inches, less than 3¼ inches, less than 4 inches, less than 4¾ inches, less than 5½ inches, less than 6¼ inches, less than 7 inches, or greater than 7 inches. In some cases, a width of each wall support 16 may be the same for an entire wall or wall system 10 or a width of a wall support 16 may be different than a width of at least one other wall support 16 of the wall or wall system 10.

Further, each of the wall supports 16 may have a depth (e.g., extending between an interior 28 side and an exterior 30 side of the wall support 16) that depends on an application of use of the wall support 16. In one example, a wall support 16 may have a depth of less than four (4) inches, less than six (6) inches, less than eight (8) inches, less than ten (10) inches, less than twelve (12) inches, less than fourteen (14) inches, less than sixteen (16) inches, less than eighteen (18) inches, or greater than eighteen (18) inches. In some cases, a depth of each wall support 16 may be the same for an entire wall or wall system 10 or a depth of a wall support 16 may be different than a depth of at least one other wall support 16 of the wall or wall system 10.

FIGS. 4-10 depict various configurations of wall supports 16. Like features of the various configurations of the wall supports 16 will be described primarily with respect to the in-line support 32 having the configuration of the wall support 16 of FIG. 4, but the discussion may apply equally to the wall support 16 having configurations depicted in FIGS. 6-10 and/or other wall supports 16.

As shown in the Figures, the wall supports 16 may include a ballistic resistant component 42, a support structure 44, and trim or casing 24. Although trim or casing 24 is included with the wall support configurations of FIGS. 3-10, the trim or casing 24 may be omitted or added after installation of the in-line support in a wall or wall system 10. When the trim or casing 24 is added after installation, a weight of a wall support 16 may be reduced during installation and an installed wall support 16 may be customized as desired after installation by adding trim or casing 24 to an installed wall support 16.

The support structure 44 may take on any form configured to provide structural support to the wall support 16. As seen in FIGS. 3-10, the structural support may take on one of a variety of different configurations depending on a configuration of the wall support 16.

Figure 4:
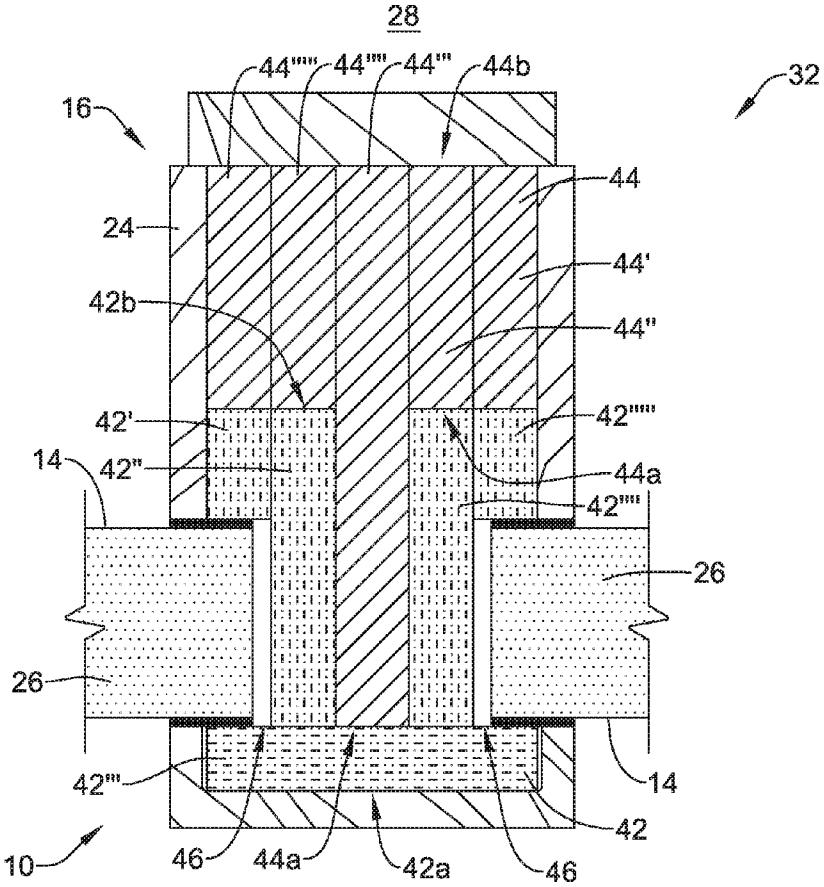
FIG. 4 is a sectional view illustrating an example in-line support, taken along line 4-4 in FIG. 2.

In some cases, the support structure 44 may have a first side 44*a* (e.g., comprising one or more sides) facing an exterior 30, a second side 44*b* (e.g., one or more sides) facing an interior 28, and one or more sides extending between the first side 44*a* and the second side 44*b*. Although the first side 44*a* and the second side 44*b* may be opposite one another in FIG. 4, this is not always necessarily the case. Further, the support structure 44 may be a single component or may include two or more sub-components joined together. For example, the support structure of an in-line support 32 depicted in FIG. 4 may include a first support structure sub-component 44', a second support structure sub-component 44", a third support structure sub-component 44''', a fourth support structure sub-component 44'''', and a fifth support structure sub-component 44''''', as shown in FIG. 4. However, a different number and/or configuration of support structure sub-components for support structures 44 of the in-line support 32 and/or other wall supports 16 (e.g., exterior corner supports 34, interior corner supports 36, exterior angled supports 38, interior angled supports 40, and/or other wall supports 16) may be utilized as desired for various applications. Additionally, although the sub-components of the support structure 44 in FIG. 4 are closely packed, the support structure 44 of wall supports 16 may include one or more spaces between adjacent sub-components.

When the support structure 44 includes two or more sub-components, the sub-components may be connected in any manner. In some cases, the two or more subcomponents may be rigidly connected with one another via adhesive bonding, nails, screws, and/or other joining techniques. In one example, the sub-components of the support structure 44 may be bonded together with an adhesive.

The support structure 44 may be formed from any material. For example, the support structure 44 may be formed from any structural framing materials including, but not limited to, metal (e.g., aluminum, steel, etc.), polymer, solid wood (e.g., hardwoods or other solid wood), strand board, timber strand, or other structural framing material. In some cases, a solid wood, strand board, timber strand, or other wood based material may be desirable to use as material of the support structure 44 to facilitate joining other materials (e.g., trim or casing 24 (e.g., wood trim or casing), ballistic resistant material, etc.) to the support structure 44 through the use of adhesives, nails, screws, and other joining techniques, particularly when compared to using metal materials or other non-wood based materials for the support structure 44.

The ballistic resistant component 42 may be connected to the support structure 44 and may span at least a portion of the support structure 44. In one example, the ballistic resistant component 42 may span along all of (e.g., an entirety of) or at least part of the first side 44*a* of the support structure 44. That is, in some cases, the ballistic resistant component 42 may cover an entirety or a substantial entirety (e.g, at least 50%, at least 75%, at least 90%, at least 95%, at least 98%, or other percent) of the first side 44*a* of the support structure 44.

The ballistic resistant component 42 may be connected to the support structure 44 in any manner with any connection technique. In one example, the ballistic resistant component 42 may be connected to the support structure 44 via an adhesive bond or some other rigid connection. Although not shown, in some cases, the ballistic resistant component 42 may be connected to the support structure 44 with a fastener (e.g., a screw or other fastener) to create a rigid connection therebetween. Further, although not required in all cases, the support structure 44 may abut all surfaces of the ballistic resistant component 42 that are adjacent to and are facing the support structure 44 (e.g., the first side 44*a* of the support structure 44).

The ballistic resistant component 42 may take on any form configured to provide ballistic resistance for the wall support 16. As seen in FIGS. 4-10, the ballistic resistant component may take on one of a variety of different configurations depending on a configuration of the wall support 16.

In some cases, the ballistic resistant component 42 may have a first side 42*a* facing an exterior 30, a second side 42*b* facing an interior 28, and one or more sides extending between the first side 42*a* and the second side 42*b*. Further, the ballistic resistant component 42 may define one or more pockets 46 at a location between the first side 42*a* and the second side 42*b*. In some cases, the ballistic resistant component 42 may define a single pocket 46 (e.g., see FIG. 10), define two pockets 46 (e.g., see FIGS. 4-9), or more than two pockets 46.

The pockets 46 of the wall support 16 may be configured to receive wall panels 14 with and engage the wall panels 14 in any manner. In some cases, the pockets 46 of the wall support 16 may engage the wall panels 14 with a friction fit from one or more seals, pieces of glazing tape, and/or other material configured to create an air-tight engagement between the ballistic resistant component 42 and the wall panel 14.

Each of the pockets 46 of the ballistic resistant component 42 may be particularly sized and configured to receive a wall panel 14 of the wall or wall system 10. For example, the pockets 46 may be configured to receive an edge of the wall panel 14 and surround the edge of the wall panel 14. In some cases, the pocket 46 of a wall support 16 have a depth configured to receive the wall panel 14 and surround a portion of wall panel 14 including an edge thereof. For example, the pocket 46 may have a depth of less than a ⅛ inch, less than a ¼ inch, less than a ½ inch, greater than or equal to a ½ inch, or other range of depths. In one illustrative example, the pocket may have a depth of or about 7⁄16 inch, but this is not required.

Further, the ballistic resistant component 42 of a wall support 16 may be configured to span gaps between other pockets 46 for wall panels 14 and/or between a pocket 46 and other ballistic resistant feature of a wall or wall system 10 to ensure the wall or wall system 10 has no gaps in protection from ballistic materials. As shown in FIGS. 4-9, the ballistic resistant component 42 may span a distance between the pockets 46 when the ballistic resistant component 42 forms two pockets. As shown in FIG. 10, the ballistic resistant component 42 may extend to a location overlapping with another bullet resistant structural component when the wall support 16 forms an end of a wall or wall system 10.

The overlap of the pocket 46 and an edge of the wall panel 14 received within the pocket 46 and ballistic resistant material of the ballistic resistant component 42 spanning gaps between pockets 46 or to a location overlapping with another ballistic resistant structural component ensures a wall or wall system 10 maintains ballistic resistant integrity at edges of the wall panels 14 and/or between the wall panels 14. As standard walls or wall systems 10 that include ballistic resistant materials have weak points at edges of wall panels and/or at locations between wall panels (e.g., having a lower ballistic resistance rating under the current UL 752 standard than other portions of the wall panel 14), the configuration of the wall supports 16 discussed herein improve on what is standard and facilitate a wall or wall system 10 that is a continuous ballistic resistant barrier.

Further, the ballistic resistant component 42 may be a single component or may include two or more sub-components joined together. For example, the ballistic resistant component 42 of an in-line support 32 depicted in FIG. 4 may include a ballistic resistant sub-component 42', a second ballistic resistant sub-component 42", a third ballistic resistant sub-component 42''', a fourth ballistic resistant sub-component 42'''', and a fifth ballistic resistant sub-component 42''''', as shown in FIG. 4. However, the ballistic resistant component 42 may include fewer than five sub-components or more than five sub-components, if any at all.

The ballistic resistant component 42 may define one or more pockets 46. The pockets 46 may have one or more walls having one or more orientations with respect to adjacent walls. In some cases, the first ballistic resistant sub-component 42' may define a first side wall, the second ballistic resistant sub-component 42" may define a second side wall, and the third ballistic resistant sub-component 42''' may define a third side wall and together may define a pocket 46 for receiving a ballistic resistant wall panel 14. Similarly, the third ballistic resistant sub-component 42''' may define a first side wall, the fourth ballistic resistant sub-component 42'''' may define a second side wall, and the fifth ballistic resistant sub-component 42''''' define a third side wall that together may define another pocket 46 for receiving a ballistic resistant wall panel 14. The walls of the pockets may be orthogonal to one another, but this is not required. In one example, two or more sub-components of the ballistic resistant component 42 may be located at right angles (e.g., ninety degrees) to one another to at least partially define the pocket 46. Alternatively or in addition, the pocket 46 may take on one or more different geometric shapes configured to receive and at least partially surround the wall panel 14. When the third ballistic resistant sub-component 42''' extends between (e.g., spans) and partially defines the two pockets 46, such a configuration may ensure ballistic resistant material spans across and/or covers a first side 44*a* of the support structure 44 in a manner that is supported by other portions of the ballistic resistant component 42. In some cases, a different number and/or configuration of ballistic resistant sub-components for ballistic resistant components 42 of the in-line support 32 and/or other wall supports 16 (e.g., exterior corner supports 34, interior corner supports 36, exterior angled supports 38, interior angled supports 40, and/or other wall supports 16) may be utilized as desired for various applications.

The ballistic resistant component 42 may be formed from any ballistic resistant material. The ballistic resistant material of the ballistic resistant component 42 may be the same ballistic resistant material used for the wall panels 14 or a different ballistic resistant material (e.g., transparent glass for wall panels 14 and fiberglass material for the wall supports). In some cases, the ballistic resistant component 42 may be fabricated from fiberglass, metal (e.g., steel armor or other metal), or other material known in the art or developed in the future for mitigating penetration of ballistic material through the material.

In some cases, the fiberglass material used to form or at least partially form the ballistic resistant component 42 may include filaments of glass fiber, such as E-glass, aramide, polyethylene (e.g. PE-UHMW polyethylene or other polyethylene), and/or other high strength fibers. Although not required, such fibers or filaments may be disposed generally parallel to one another in layers in a matrix of a thermoplastic or thermosetting plastic (e.g., polypropylene, epoxy resin, phenolic resin, PUR, polyethylene, or other thermoplastic or thermosetting plastic). In one example, fibers or filaments of a layer of the fiberglass material may cross fibers or filaments of an adjacent layer, or may form a woven fabric, with a plurality of layers of said fabric being combined in a matrix of thermoplastic or thermosetting plastic to form a panel. Other types of materials and/configurations of materials may be utilized to form the ballistic resistant component 42.

The ballistic resistant component 42 may have various thicknesses that facilitate various ballistic resistant level ratings (e.g., bullet resistant levels under the current UL 752 standard, levels under NIJ body armor classifications, or other ballistic resistance standards) depending on ballistic material type. In some cases, the ballistic resistant component 42 may have a thickness (e.g., a thickness of the ballistic resistant material discussed herein and/or a thickness of the ballistic resistant material and additional layers of other material) between about 1/16" and 1½", or a greater thickness. Under the current UL 752 standard, a ballistic resistant component 42 having a thickness of about ⅛" may have a Level 2 bullet resistance rating, and a ballistic resistant component 42 having a thickness of about 7/16" may have a Level 3 bullet resistance rating, which are just some examples of ratings. Further, in some cases, ballistic resistant material may have a standard thickness and the material may be stacked to form a ballistic resistant component 42 having a greater bullet resistant rating than a ballistic resistant component formed of a single standard thickness bullet resistant material (e.g., a rating indicative of providing greater protection against ballistic material penetrating the ballistic resistant component 42).

As referred to above, the wall supports 16 may include trim or casing 24 (as shown in the Figures) or some other finish. The trim or casing 24 may be connected to and/or over cover all or a portion of the ballistic resistant component 42, support structure 44, and/or other portions of the wall supports 16. In one example, the trim or casing 24 may be applied to the ballistic resistant component 42 to form all or at least part of an exterior surface of the wall support 16 and/or the trim or casing 24 may be applied to the support structure 44 to form all or at least part of an interior surface. Alternatively, or in addition, the trim or casing 24 may be applied to the support structure 44 to form all or at least part of the exterior surface of the wall support 16 and/or the trim or casing 24 may be applied to the ballistic resistant component 42 to form all or at least part of the interior surface of the wall support 16.

Figure 5:
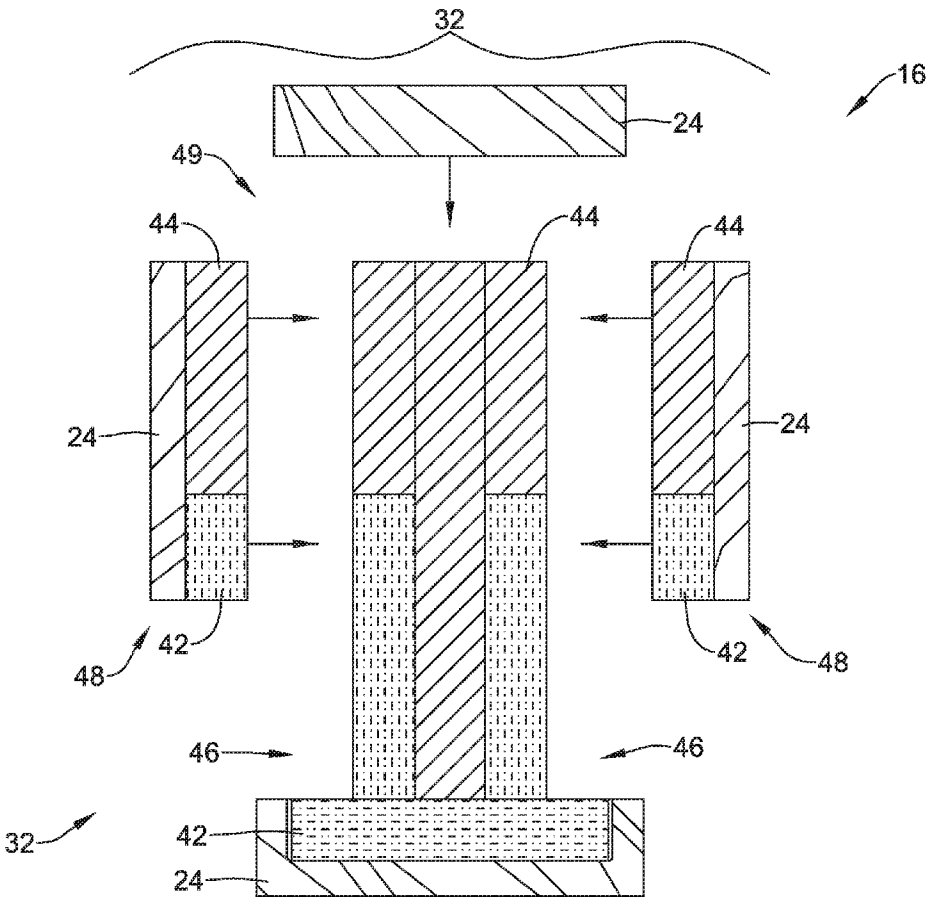
FIG. 5 is a partial exploded view of the example in-line support sectional view of FIG. 4, depicting a stop component.

To reduce weight, protect finishes, to facilitate receiving a wall panel 14 and/or for one or more other purposes, the wall support 16 may include one or more separable components, as shown in FIG. 5. For example, the wall support 16 may include trim or casing 24 that may be added to the wall support 16 after installation of the wall support 16 in a wall or wall system 10 and/or removed and modified (e.g., for remodeling or refinishing of a space) or replaced. Further, in some cases, the wall support 16 may include one or more stop components 48 that may be separate from a main body 49 at least partially defining a pocket 46. The main body 49 of the wall support 16 may be any portion of the wall support 16 not included with the stop component 48 and may comprise at least a portion of the ballistic resistant component 42 and/or at least a portion of the support structure 44. In some cases, the pocket 46 may be at least partially by a ballistic resistant component 42 sub-component of the main body 49 and a ballistic resistant component 42 sub-component of the stop component 48.

As shown in FIG. 5, the in-line support 32 may include two stop components 48, where each stop component 48 may include a trim or casing 24 portion, a sub-component of the ballistic resistant component 42, and a sub-component of the support structure 44. However, the stop component 48 may include one or more other portions of the wall support 16 and/or may omit one or more of the trim or casing 24, the sub-component of the ballistic resistant component 42, and the sub-component of the support structure 44. Although not separated out or indicated for clarity purposes, each of the wall supports 16 in FIGS. 4-10 may include a stop component 48 that may form part of the pocket 46, but this is not required.

In some cases, the stop component 48 may be connected (e.g., rigidly connected via an adhesive or other fastener) to other portions of the wall support 16 after moving the wall support 16 to an install site and/or after at least partially installing the wall support 16 and positioning a wall panel 14 into the pocket 46. In cases when the wall panel 14 is positioned within a pocket 46 prior to connecting the stop component 48, the wall panel 14 may be easily received within the pocket 46 and the stop component 48 may be connected after receiving the wall panel 14 to secure the wall panel 14 within the pocket 46.

FIGS. 6-10 depict various configurations of wall supports 16. Although not necessarily discussed in detail for clarity purposes, the configurations of wall supports 16 depicted in FIGS. 6-10 may include the various features discussed above with respect to the in-line support 32 depicted in FIGS. 4 and 5 as adapted for each different configuration.

Figure 6:
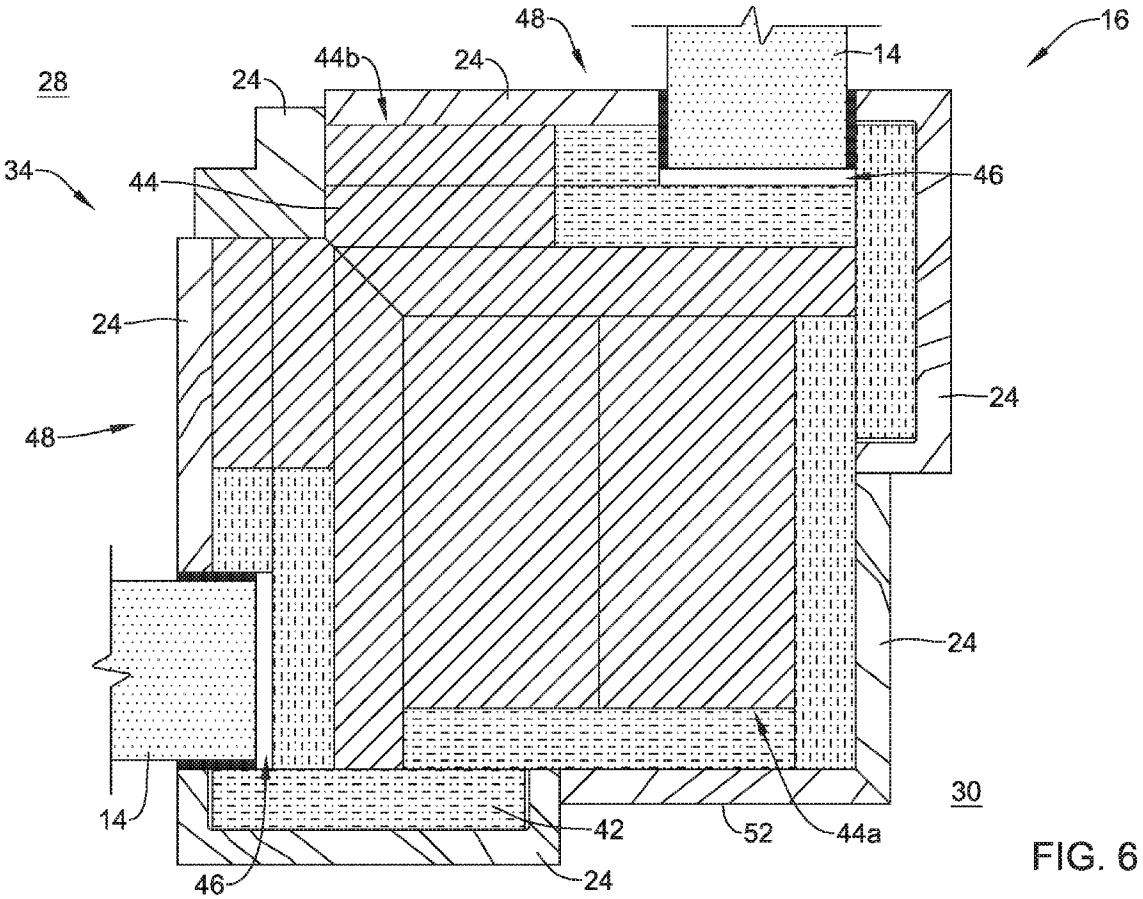
FIG. 6 is a sectional view illustrating an example exterior corner support.

FIG. 6 depicts a sectional view of an illustrative exterior corner support 34 configuration of a wall support 16 that may be configured to form a corner (e.g., a ninety degree corner or other corner) of a wall or wall system 10. A majority of a wall surface 52 of the exterior corner support 34 may be located exterior 30 of an enclosed or interior 28 space. The exterior corner support 34 may include a ballistic resistant component 42, a support structure 44, trim or casing 24 connected to and/or covering all or at least part of the ballistic resistant component 42 and the support structure 44, and/or a stop component 48 (shown connected to other portions of the wall support 16 and forming a pocket 46). In addition to or as an alternative to including trim or casing 24, the exterior corner support 34 may include one or more other finishing features on or attached to one or more of the ballistic resistant component 42 and the support structure 44.

The ballistic resistant component 42 and/or the support structure 44 of the exterior corner support 34 may be configured in any manner, such that when used in a wall or wall system 10, the ballistic resistant component 42 may facilitate providing a continuous ballistic resistant barrier with other ballistic resistant portions of the wall or wall system 10 and the support structure 44 supports the ballistic resistant component 42 and the wall or wall system 10. In some cases, the support structure 44 may have a first side **44*a* and a second side 44*b*, and the ballistic resistant component 42 may span an entirety or substantially an entirety of the first side 44*a*, but this is not required. In one example, the first side 44*a* of the support structure 44 may be an exterior 30 facing side of the support structure 44 and the ballistic resistant component 42 may span an entirety or substantially an entirety of the exterior 30 facing side of the support structure 44 between other ballistic resistant components 42 of the wall or wall system 10. Additionally or alternatively, the ballistic resistant component 42 may extend along a side of the support structure 44** facing an enclosed or interior space.

The ballistic resistant component 42 may form one or more pockets 46 for receiving a wall panel 14. As shown in FIG. 6, the ballistic resistant component 42 of the exterior corner support 34 may define two pockets 46 and may extend between the two pockets 46. As the exterior corner support 34 may form a corner of a wall or wall system 10, and particularly about a ninety degree corner, the pockets 46 of the exterior corner support 34 may be configured to each receive a wall panel 14 such that the received wall panels 14 may be positioned about ninety degrees apart from one another or at another angle with respect to one another. Further, the pockets 46 may be located in the exterior corner support 34 such that a majority of a wall surface 52 of the wall support 16 is exterior of the enclosed or interior 28 space. Of course, the pockets 46 may be alternatively located such that a majority of a wall surface 52 of the wall support 16 is within the enclosed or interior 28 space.

Additionally or alternatively, the exterior corner support 34 may include less than or more than two pockets 46.

Figure 7:
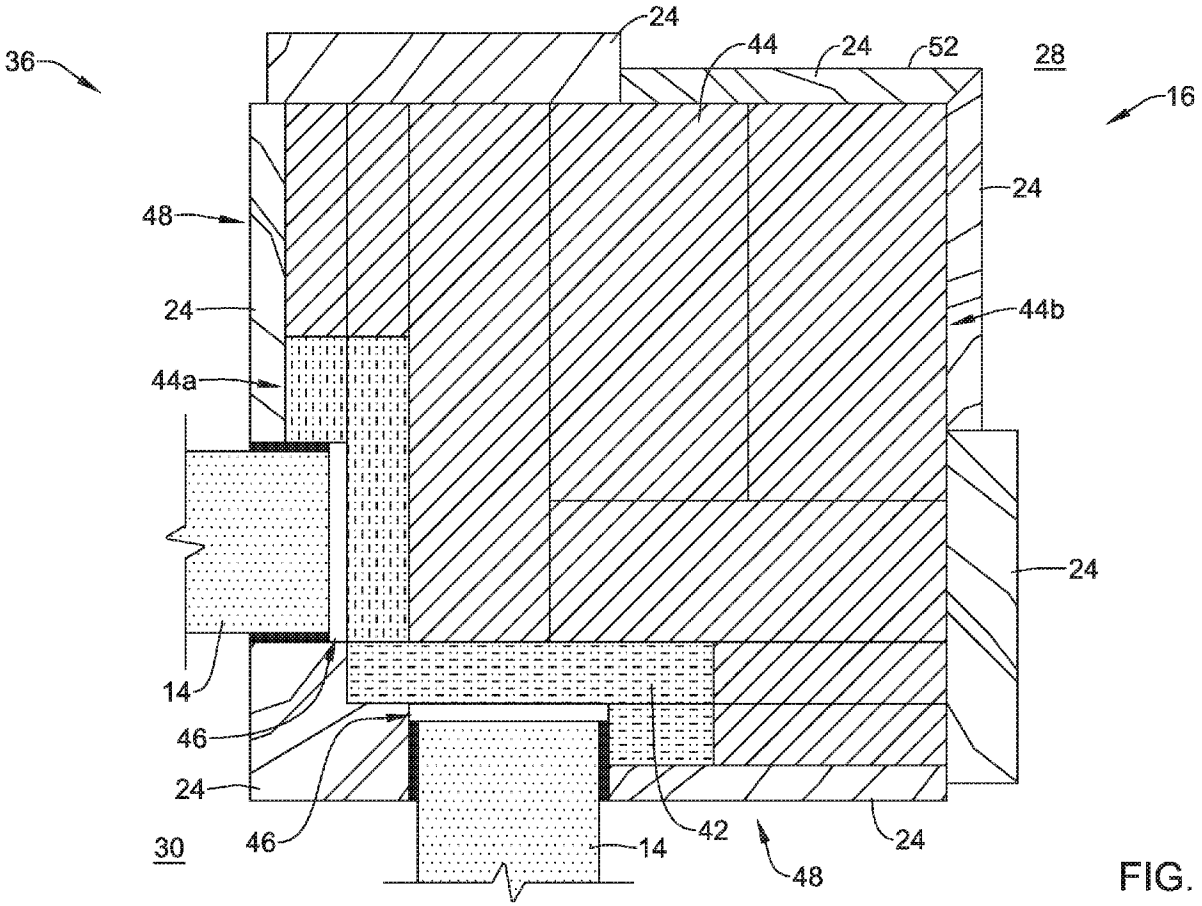
FIG. 7 is a sectional view illustrating an example interior corner support.

FIG. 7 depicts a sectional view of an illustrative interior corner support 36 configuration of a wall support 16 that may be configured to form a corner (e.g., a ninety degree corner or other corner) of a wall or wall system 10. A majority of the wall surface 52 of the interior corner support 36 may be located within an enclosed or interior 28 space. The interior corner support 36 may include a ballistic resistant component 42, a support structure 44, trim or casing 24 connected to and/or covering all or at least part of the ballistic resistant component 42 and the support structure 44, and/or a stop component 48 (shown connected to other portions of the wall support 16 and forming a pocket 46). In addition to or as an alternative to including trim or casing 24, the interior corner support 36 may include one or more other finishing features on or attached to one or more of the ballistic resistant component 42 and the support structure 44.

The ballistic resistant component 42 and/or the support structure 44 of the interior corner support 36 may be configured in any manner, such that when used in a wall or wall system 10, the ballistic resistant component 42 may facilitate providing a continuous ballistic resistant barrier with other ballistic resistant portions of the wall or wall system 10 and the support structure 44 supports the ballistic resistant component 42 and the wall or wall system 10. In some cases, the support structure 44 may have a first side 44*a* and a second side 44*b*, and the ballistic resistant component 42 may span an entirety or substantially an entirety of the first side 44*a*, but this is not required. In one example, the first side 44*a* of the support structure 44 may be an exterior facing side of the support structure 44 and the ballistic resistant component 42 may span an entirety or substantially an entirety of the exterior 30 facing side of the support structure 44 between other ballistic resistant components 42 of the wall or wall system 10. Additionally or alternatively, the ballistic resistant component 42 may extend along a side of the support structure 44 facing an enclosed or interior space.

The ballistic resistant component 42 may form one or more pockets 46 for receiving a wall panel 14. As shown in FIG. 7, the ballistic resistant component 42 of the interior corner support 36 may define two pockets 46 and may extend between the two pockets 46. As the interior corner support 36 may form a corner of a wall or wall system 10, and particularly about a ninety degree corner, the pockets 46 of the interior corner support 36 may be configured to each receive a wall panel 14 such that the received wall panels 14 may be positioned about ninety degrees apart from one another or at another angle with respect to one another. Further, the pockets 46 may be located in the interior corner support 36 such that a majority of a wall surface 52 of the wall support 16 is within the enclosed or interior 28 space. Of course, the pockets 46 may be alternatively located such that a majority of a wall surface 52 of the wall support 16 is exterior of the enclosed or interior 28 space. Additionally or alternatively, the interior corner support 36 may include less than or more than two pockets 46.

Figure 8:
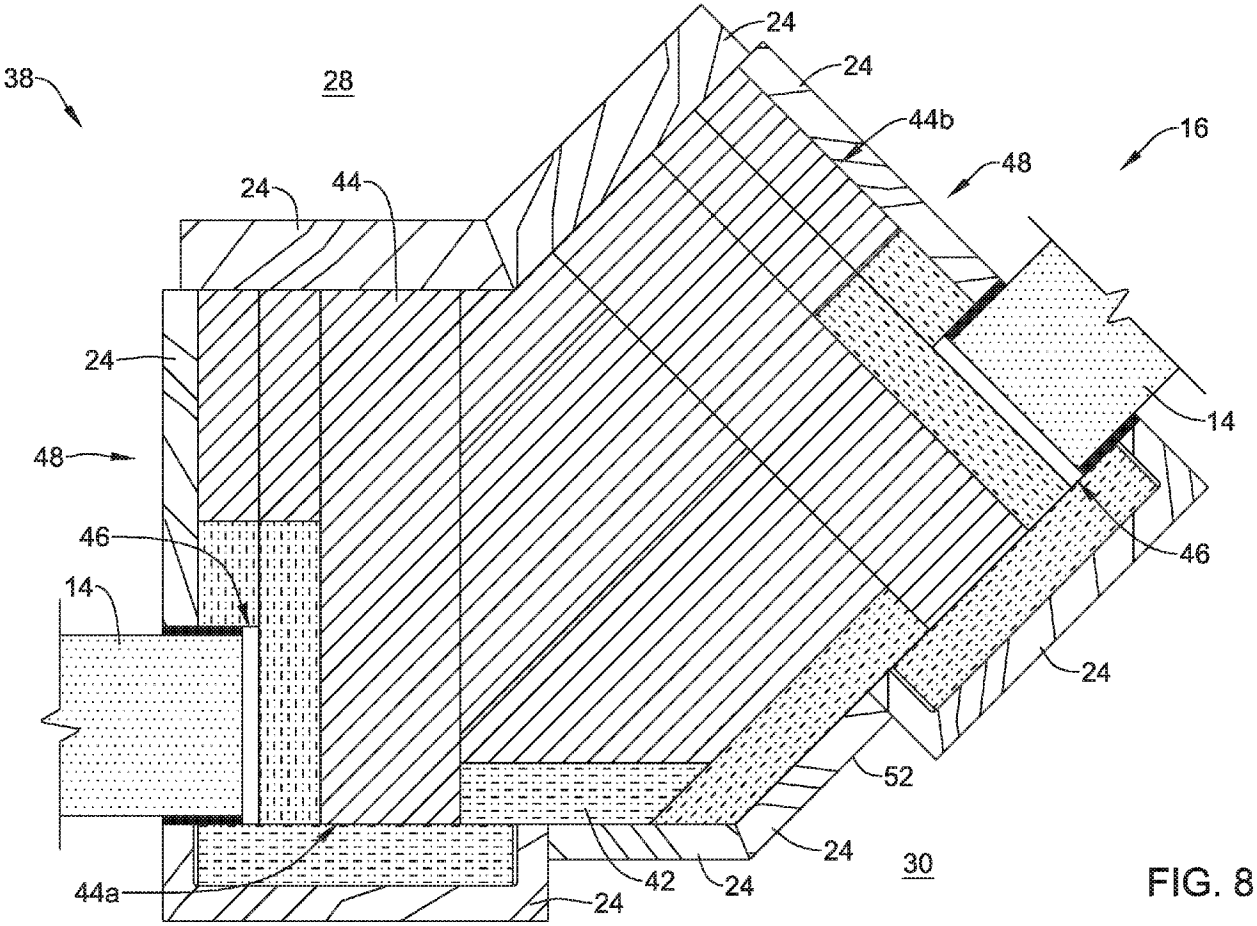
FIG. 8 is a sectional view illustrating an example exterior angled support.

FIG. 8 depicts a sectional view of an illustrative exterior angled support 38 configuration of a wall support 16 that may be configured to form an angle (e.g., an angle less than 180 degrees, and not ninety degrees measured on the interior 28 side of the wall support 16) of a wall or wall system 10. A majority of the wall surface 52 of the exterior angled support 38 may be located exterior of an enclosed or interior 28 space. The exterior angled support 38 may include a ballistic resistant component 42, a support structure 44, trim or casing 24 connected to and/or covering all or at least part of the ballistic resistant component 42 and the support structure 44, and/or a stop component 48 (shown connected to other portions of the wall support 16 and forming a pocket 46). In addition to or as an alternative to including trim or casing 24, the exterior angled support 38 may include one or more other finishing features on or attached to one or more of the ballistic resistant component 42 and the support structure 44.

The ballistic resistant component 42 and/or the support structure 44 of the exterior angled support 38 may be configured in any manner, such that when used in a wall or wall system 10, the ballistic resistant component 42 may facilitate providing a continuous ballistic resistant barrier with other ballistic resistant portions of the wall or wall system 10 and the support structure 44 may support the ballistic resistant component 42 and the wall or wall system 10. In some cases, the support structure 44 may have a first side 44*a* and a second side 44*b*, and the ballistic resistant component 42 may span an entirety or substantially an entirety of the first side 44*a*. In one example, the first side 44*a* of the support structure 44 may be an exterior 30 facing side of the support structure 44 and the ballistic resistant component 42 may span an entirety or substantially an entirety of the exterior 30 facing side of the support structure 44 between other ballistic resistant components 42 of the wall or wall system 10. Additionally or alternatively, the ballistic resistant component 42 may extend along a side of the support structure 44 facing an enclosed or interior 28 space.

The ballistic resistant component 42 may form one or more pockets 46 for receiving a wall panel 14. As shown in FIG. 8, the ballistic resistant component 42 of the exterior angled support 38 may define two pockets 46 and may extend between the two pockets 46. As the exterior angled support 38 may form an angle in a wall or wall system 10, and particularly an angle less than about 180 degrees when measured on the interior 28 side, the pockets 46 of the exterior angled support 38 may be configured to each receive a wall panel 14 such that the received wall panels 14 may be positioned less than 180 degrees apart from one another as measured from the interior 28 side. Further, the pockets 46 may be located in the exterior angled support 38 such that a majority of a wall surface 52 of the wall support 16 is exterior of the enclosed or interior 28 space. Of course, the pockets 46 may be alternatively located such that a majority of a wall surface 52 of the wall support 16 is within the enclosed or interior 28 space. Additionally or alternatively, the exterior angled support 38 may include less than or more than two pockets 46.

Figure 9:
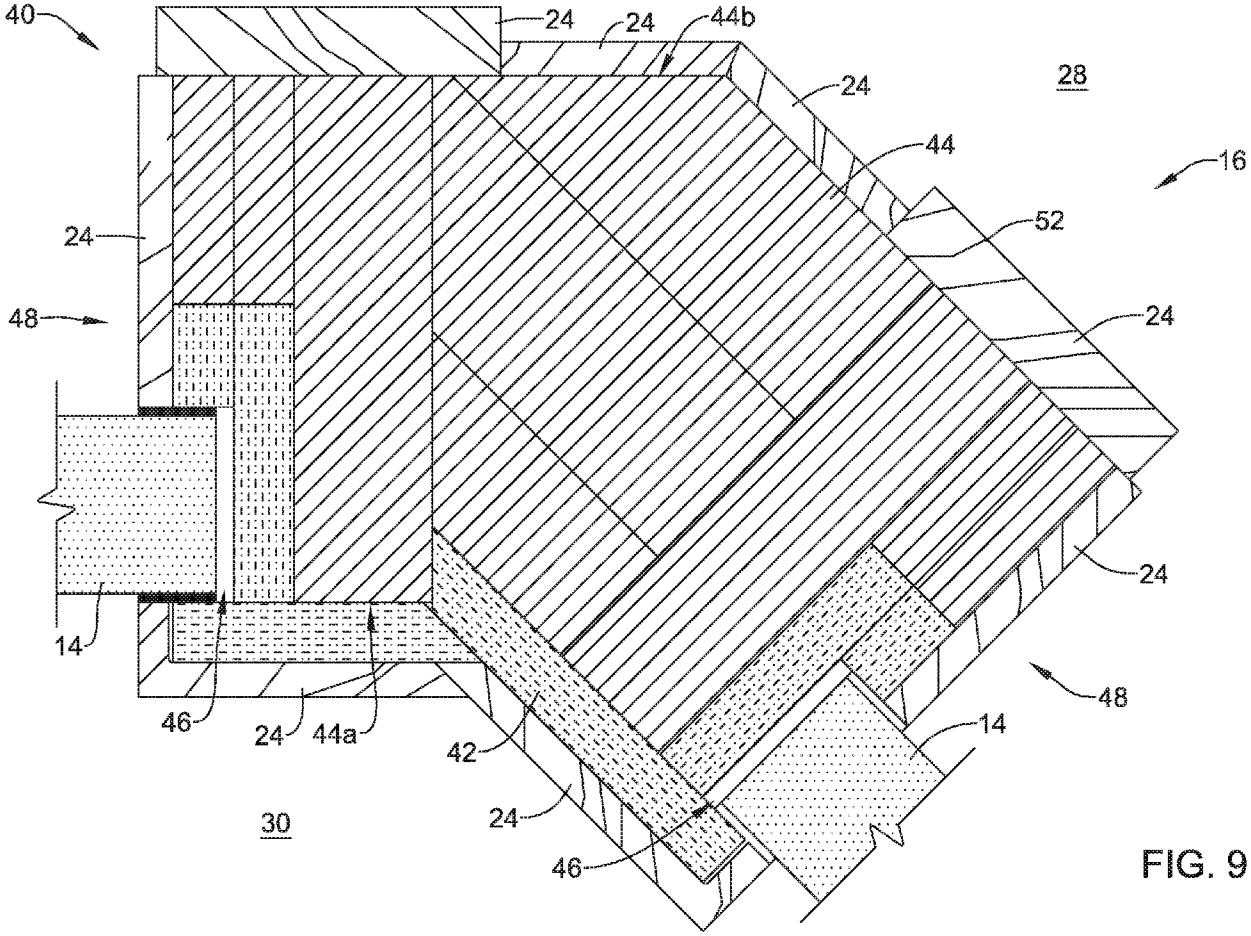
FIG. 9 is a sectional view illustrating an example interior angled support.
Figure 10:
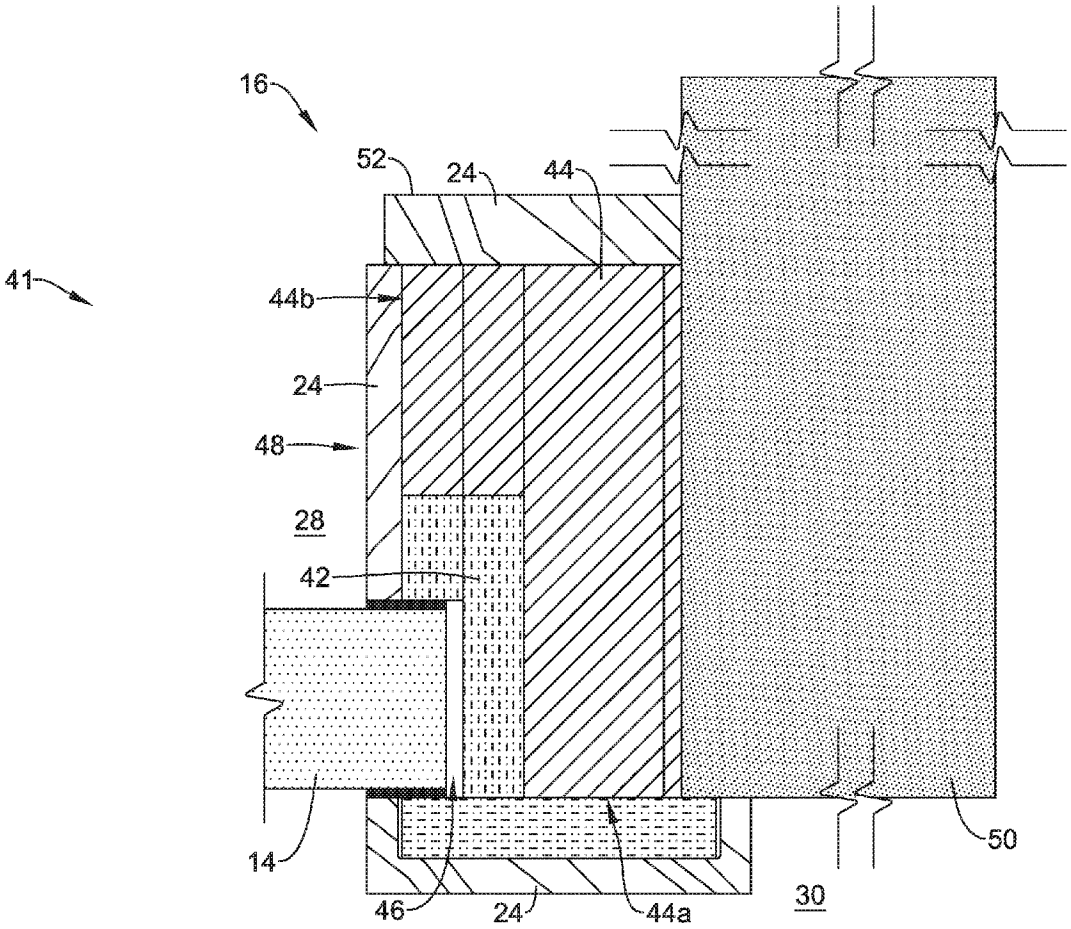
FIG. 10 is a sectional view illustrating an example end support.

FIG. 9 depicts a sectional view of an illustrative interior angled support 40 configuration of a wall support 16 that may be configured to form an angle (e.g., an angle greater than 180 degrees as measured on the interior 28 side of the wall support 16) of a wall or wall system 10. A majority of the wall surface 52 of the interior angled support 40 may be located within an enclosed or interior 28 space. The interior angled support 40 may include a ballistic resistant component 42, a support structure 44, trim or casing 24 connected to and/or covering all or at least part of the ballistic resistant component 42 and the support structure 44, and/or a stop component 48 (shown connected to other portions of the wall support 16 and forming a pocket 46). In addition to or as an alternative to including trim or casing 24, the interior angled support 40 may include one or more other finishing features on or attached to one or more of the ballistic resistant component 42 and the support structure 44.

The ballistic resistant component 42 and/or the support structure 44 of the interior angled support 40 may be configured in any manner, such that when used in a wall or wall system 10, the ballistic resistant component 42 may facilitate providing a continuous ballistic resistant barrier with other ballistic resistant portions of the wall or wall system 10 and the support structure 44 may support the ballistic resistant component 42 and the wall or wall system 10. In some cases, the support structure 44 may have a first side 44*a* and a second side 44*b*, and the ballistic resistant component 42 may span an entirety or substantially an entirety of the first side 44*a*. In one example, the first side 44*a* of the support structure 44 may be an exterior 30 facing side of the support structure 44 and the ballistic resistant component 42 may span an entirety or substantially an entirety of the exterior 30 facing side of the support structure 44 between other ballistic resistant components 42 of the wall or wall system 10. Additionally or alternatively, the ballistic resistant component 42 may extend along a side of the support structure 44 facing an enclosed or interior space.

The ballistic resistant component 42 may form one or more pockets 46 for receiving a wall panel 14. As shown in FIG. 9, the ballistic resistant component 42 of the interior angled support 40 may define two pockets 46 and may extend between the two pockets 46. As the interior angled support 40 may form an angle in a wall or wall system 10, and particularly an angle greater than about 180 degrees when measured on the interior 28 side, the pockets 46 of the exterior angled support 38 may be configured to each receive a wall panel 14 such that the received wall panels 14 may be positioned greater than 180 degrees apart from one another as measured from the interior 28 side. Further, the pockets 46 may be located in the interior angled support 40 such that a majority of a wall surface 52 of the wall support 16 is within the enclosed or interior 28 space. Of course, the pockets 46 may be alternatively located such that a majority of a wall surface 52 of the wall support 16 is exterior of the enclosed or interior 28 space. Additionally or alternatively, the interior angled support 40 may include less than or more than two pockets 46.

FIG. 10 depicts a sectional view of an end support 41 configuration of a wall support 16 that may be configured to form a header, a footer, a vertical side end, and/or other end of a wall or wall system 10 at an additional ballistic resistant structure 50. In some cases, the ballistic resistant structure may be a structural wall of a building, a door frame (e.g., the door frame 20), or other ballistic resistant wall or wall system. In some cases, a majority of the wall surface 52 of the end support 41 may be located within an enclosed or interior 28 space, but this is not required. The end support 41 may include a ballistic resistant component 42, a support structure 44, trim or casing 24 connected to and/or covering all or at least part of the ballistic resistant component 42 and the support structure 44, and/or a stop component 48 (shown connected to other portions of the wall support 16 and forming a pocket 46). In addition to or as an alternative to including trim or casing 24, the end support 41 may include one or more other finishing features on or attached to one or more of the ballistic resistant component 42 and the support structure 44.

The ballistic resistant component 42 and/or the support structure 44 of the end support 41 may be configured in any manner, such that when used in a wall or wall system 10, the ballistic resistant component 42 may facilitate providing a continuous ballistic resistant barrier with other ballistic resistant portions of the wall or wall system 10 and/or other walls and the support structure 44 may support the ballistic resistant component 42 and the wall or wall system 10. In some cases, the support structure 44 may have a first side 44*a* and a second side 44*b*, and the ballistic resistant component 42 may span an entirety or substantially an entirety of the first side 44*a*. In one example, the first side 44*a* of the support structure 44 may be an exterior 30 facing side of the support structure 44 and the ballistic resistant component 42 may span an entirety or substantially an entirety of the exterior 30 facing side of the support structure 44 between other ballistic resistant components of the wall or wall system 10 and/or other ballistic resistant walls. Additionally or alternatively, the ballistic resistant component 42 may extend along a side of the support structure 44 facing an enclosed or interior space.

The ballistic resistant component 42 may form one or more pockets 46 for receiving a wall panel 14. As shown in FIG. 10, the ballistic resistant component 42 of the end support 41 may define a single pocket 46 and may extend from the single pocket 46 and overlap with an additional ballistic resistant structure 50. As terminal edges of typical or standard ballistic resistant walls or wall systems may be known weak portions of the ballistic resistant walls, the ballistic resistant component 42 extending from the pocket 46 receiving the wall panel 14 to a position overlapping with the additional ballistic resistant structure 50 may facilitate forming a continuous ballistic resistant wall or wall system 10. Further, the pocket 46 may be located in the end support 41 such that a majority of a wall surface 52 of the wall support 16 is within the enclosed or interior 28 space. Of course, the pocket 46 of the end support 41 may be alternatively located such that a majority of a wall surface 52 of the wall support 16 is exterior of the enclosed or interior 28 space. Additionally or alternatively, the end support 41 may include more than one pocket 46.

Figure 11:
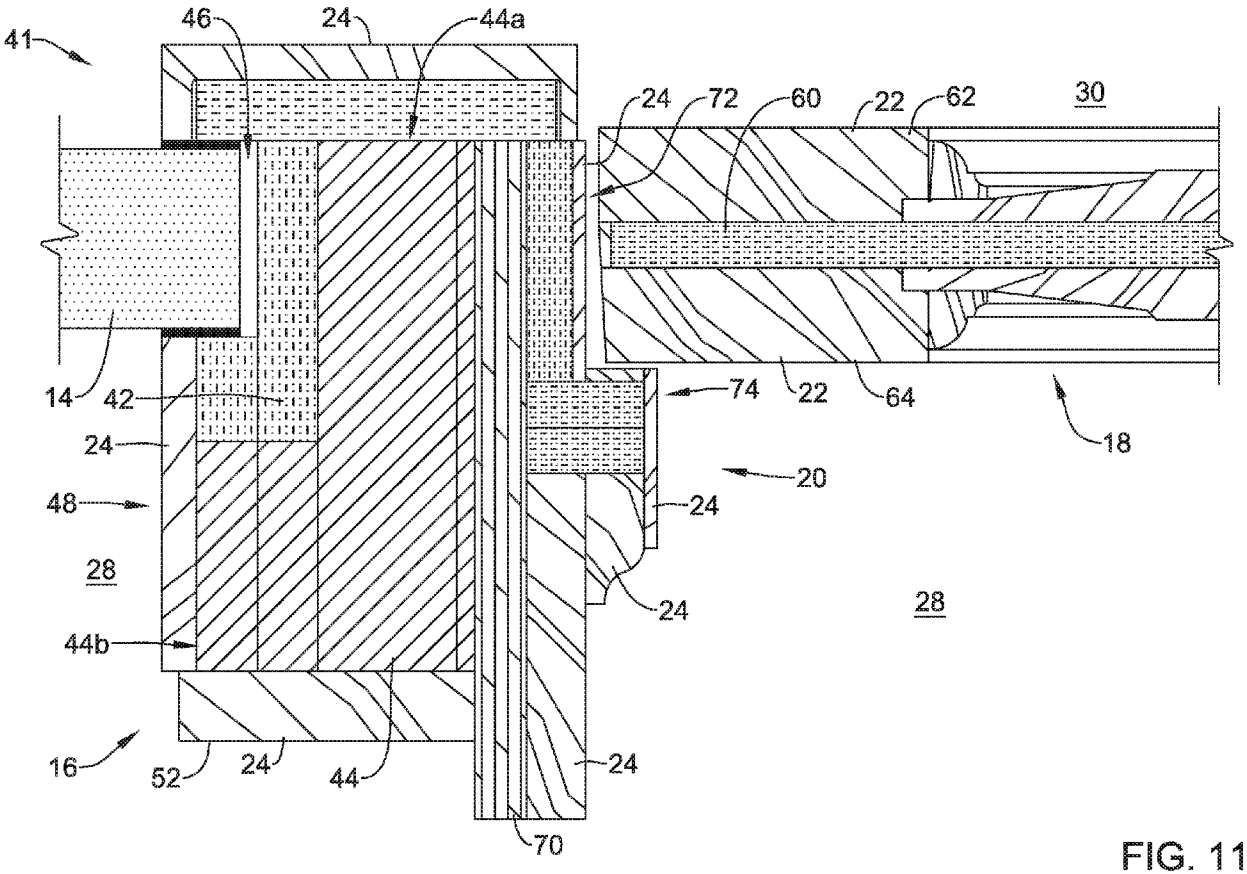
FIG. 11 is a sectional view illustrating an example door, door frame, and wall support.

FIG. 11 depicts a partial sectional view of a door 18 and frame 20 for a wall or wall system 10. When the door 18 and the frame 20 are included in the wall or wall system 10 including ballistic resistant wall panels 14 and ballistic resistant wall supports 16, the wall or wall system 10 may create a continuous ballistic resistant barrier.

Although the door 18 may be any type of ballistic resistant door, the door 18 depicted in FIG. 11 may include a ballistic resistant core 60 sandwiched between an exterior layer 62 (e.g., a hardwood 22, a finished metal, a finished polymer, or other finishing material) on an exterior 30 side of the door 18 and an interior layer 64 (e.g., a hardwood 22, a finished metal, a finished polymer, or other finishing material) on an interior 28 side of the door 18. The ballistic resistant core 60 may be configured from the ballistic resistant material discussed herein and/or other ballistic resistant material. In some cases, the exterior layer 62 and the interior layer 64 may facilitate concealing the ballistic resistant nature of the door 18.

The frame 20 may be formed from a structural support component 70, a jamb 72, one or more door stops 74, a header (not shown, but which may have a similar configuration as the jamb 72 and door stop 74), trim or casing 24, and/or one or more other components. To create a continuous ballistic resistant barrier between the door 18 and the frame 20 from all angles, the jamb 72 and the door stop 74 may configured from ballistic resistant material, which may be the same as or different than the ballistic resistant material discussed herein. Due to requirements to reinforce ballistic resistant material, the door stop 74 may include more than one layer of ballistic resistant material and/or have a higher bullet resistant rating (e.g., due to a greater thickness, using a different ballistic resistant material, and/or one or more other reason) than the ballistic resistant material of other ballistic resistant portions of the wall or wall system 10. Further, trim or casing 24 may be applied to the components of the frame 20 to conceal the ballistic resistance nature of the frame 20.

Further, the frame 20 may be used in conjunction with an end support 41 (as discussed with respect to FIG. 10) and/or one or more other wall supports 16 to facilitate the wall or wall system 10 creating a continuous ballistic resistant barrier. For example, the end support 41 may be abutted against the door frame 20, a wall panel 14 may be received within the pocket 46 of the end support 41, and the ballistic resistant component 42 of the end support 41 may extend from the pocket 46 and overlap with the ballistic resistant material of the jamb 72.

Those skilled in the art will recognize that the present disclosure may be manifested in a variety of forms other than the specific embodiments described and contemplated herein. For instance, as described herein, various embodiments include one or more modules described as performing various functions. However, other embodiments may include additional modules that split the described functions up over more modules than that described herein. Additionally, other embodiments may consolidate the described functions into fewer modules.

Although various features may have been described with respect to less than all embodiments, this disclosure contemplates that those features may be included on any embodiment. Further, although the embodiments described herein may have omitted some combinations of the various described features, this disclosure contemplates embodiments that include any combination of each described feature. Accordingly, departure in form and detail may be made without departing from the scope and spirit of the present disclosure as described in the appended claims.

What is claimed is:

1. A ballistic resistant wall support having an interior side and an exterior side, the wall support comprising:

a support structure having a first side and a second side opposite the first side;

a ballistic resistant component rigidly connected to the support structure and extending along the first side of the support structure; and a stop component separate from and connected to one or both of the support structure and the ballistic resistant component, the stop component has a support structure sub-component and a ballistic resistant sub-component, and wherein when the stop component is connected to one or both of the support structure and the ballistic resistant component, the ballistic resistant component and the ballistic resistant sub-component to at least partially define a pocket for receiving a wall panel and ballistic resistant material of the ballistic resistant component and the ballistic resistant sub-component continuously extends around portions of two opposing sides of the wall panel when the wall panel is received in the pocket.

2. The wall support of claim 1, further comprising:

a casing connected to and covering a portion of the ballistic resistant component to form a surface of the exterior side of the wall support.

3. The wall support of claim 1, wherein the ballistic resistant component covers substantially an entirety of the first side of the support structure.

4. The wall support of claim 1, wherein the ballistic resistant component is formed from two or more ballistic resistant sub-components abutting to at least partially define the pocket.

5. The wall support of claim 4, wherein the ballistic resistant component comprises a first ballistic resistant sub-component and a second ballistic resistant sub-component connected to the first ballistic resistant sub-component at substantially a right angle to at least partially define the pocket.

6. The wall support of claim 1, wherein the ballistic resistant component forms a first wall of the pocket and a second wall of the pocket located substantially orthogonal to the first wall, and the ballistic resistant sub-component forms a third wall of the pocket located substantially orthogonal to the second wall.

7. The wall support of claim 1, wherein the support structure is formed from a wood-based structural framing material.

8. The wall support of claim 1, wherein the ballistic resistant material is formed from a ballistic resistant fiberglass.

9. A ballistic resistant mullion or transom comprising:

a pocket;

a main body at least partially defining the pocket;

a stop component separate from the main body and connected to the main body, the stop component at least partially defining the pocket; and wherein:

the main body and the stop component are each formed from a ballistic resistant material and a structural framing material; and the ballistic resistant material of the main body and the ballistic resistant material of the stop component abut to define continuous walls of the pocket with the ballistic resistant material of the main body and the stop component.

10. The ballistic resistant mullion or transom of claim 9, wherein the main body includes a ballistic resistant portion formed from the ballistic resistant material and a support portion from the structural framing material.

11. The ballistic resistant mullion or transom of claim 9, wherein the ballistic resistant material of the main body and the stop component define three walls of the pocket and the pocket is configured to receive a ballistic resistant wall panel.

12. A ballistic resistant wall system forming a continuous bullet resistant barrier, the wall system comprising:

a ballistic resistant wall support comprising:

a support structure component having a first side and a second side opposite of the first side;

a ballistic resistant component located adjacent to the first side of the support structure component, the ballistic resistant component at least partially defining a pocket;

a stop component separate from and connected to one or both of the support structure and the ballistic resistant component, the stop component at least partially defining the pocket;

wherein the stop component has a support structure sub-component and a ballistic resistant sub-component that forms a wall of the pocket when the stop component is connected to one or both of the support structure and the ballistic resistant component; and a ballistic resistant wall panel received within the pocket; and wherein ballistic resistant material of the ballistic resistant component and the ballistic resistant sub-component at least partially defining the pocket continuously extends around portions of three sides of the ballistic resistant wall panel received in the pocket.

13. The wall system of claim 12, wherein:

the ballistic resistant wall panel has a front surface facing a first direction, a back surface facing a second direction opposite of the first direction, and a side surface extending between the front surface and the back surface; and the pocket has a ballistic resistant surface extending along the front surface, the back surface, and the side surface.

14. The wall system of claim 12, wherein:

the pocket at least partially defined by the ballistic resistant component and the ballistic resistant sub-component is a first pocket and the ballistic resistant component at least partially defines a second pocket; and the ballistic resistant wall panel is a first ballistic resistant wall panel and the wall system includes a second ballistic resistant wall panel that is received within the second pocket.

15. The wall system of claim 14, wherein:

the first pocket is in a first side of the ballistic resistant component and faces a first direction;

the second pocket is spaced from the first pocket in a second side of the ballistic resistant component and faces a second direction opposite the first direction;

the support structure component separates the first pocket and the second pocket; and the ballistic resistant component has a third side facing a third direction, the third side extends along the first side of the support structure component and extends between the first pocket and the second pocket.

16. The wall system of claim 12, further comprising:

a ballistic resistant door jamb having a ballistic resistant door facing side; and a ballistic resistant stop abutting the door jamb, and wherein:

the pocket is in a first side of the ballistic resistant component and faces a first direction; and the door jamb faces a second direction opposite the first direction.

17. The wall system of claim 12, wherein the ballistic resistant component is formed from a first ballistic resistant material and the ballistic resistant wall panel is formed from a second ballistic resistant material that is different than the first ballistic resistant material.

* * * * *